United States Patent [19]

Maldonado et al.

[11] 4,440,485

[45] Apr. 3, 1984

[54] APPARATUS FOR CONTINUOUSLY AUTOMATICALLY PROCESSING A PLURALITY OF DENTAL X-RAY FILMS

[75] Inventors: Robert Maldonado, Santa Clara; Raymond A. Erickson, Gilroy, both of Calif.

[73] Assignee: Pennwalt Corporation, Philadelphia, Pa.

[21] Appl. No.: 458,374

[22] Filed: Jan. 17, 1983

[51] Int. Cl.[3] ..... G03D 3/08

[52] U.S. Cl. ..... 354/322; 354/338; 226/196

[58] Field of Search ..... 354/316, 320, 321, 322, 354/338, 339; 226/196, 198, 199; 134/64 P, 122 P

[56] References Cited

U.S. PATENT DOCUMENTS

| | | | |
|---|---|---|---|
| 3,532,048 | 10/1970 | Hope et al. | 354/320 |
| 3,701,526 | 11/1972 | Hope et al. | 354/339 |
| 3,956,764 | 5/1976 | Schausberger | 354/339 |
| 4,032,943 | 6/1977 | Zwettler | 354/322 |

*Primary Examiner*—A. A. Mathews

[57] ABSTRACT

Cooperating pairs of drive rollers propelling the film through the developer, fixer, and rinse tanks and drying area, have one roller of each pair mounted to a separate cantilever spring member formed in each of both roller frame supports which rotatably resiliently mount the roller thereby permitting plastic rollers to be employed, which require no separate springs, in lieu of expensive rubber rollers which require close control over the degree of tangential contact between individual rollers of each pair thereof and proper durometer values in order to avoid damaging moving film squeezed thereinbetween as well as proper porosity to avoid caking of dried chemicals thereon. The cantilever springs are formed by creating an air space partially therearound in the molding process of each roller frame support. Processor also employs improved film deflector guides for automatically deflecting moving film into the converging rotating rollers of successive downstream rollers disposed in a curvilinear path through the respective tanks without causing film jamming.

7 Claims, 9 Drawing Figures

APPARATUS FOR CONTINUOUSLY AUTOMATICALLY PROCESSING A PLURALITY OF DENTAL X-RAY FILMS

FIELD OF THE INVENTION

The present invention is an improvement to the dental x-ray film processing apparatus shown and described in U.S. Pat. No. 4,032,943, assigned to the assignee of the present invention and relates to improved roller support frame structure which is molded to provide a plurality of cantilevered spring segments or members which cooperate with drive rollers to thereby permit plastic rollers to be employed which require no separate springs in lieu of the more expensive rubber rollers which require frequent maintenance and tight tolerances. The invention also provides film deflector guide means for insuring jam-proof excursions for the traveling x-ray film.

BACKGROUND AND SUMMARY OF THE INVENTION

The dental x-ray film processing system and apparatus of Zwettler described in U.S. Pat. No. 4,032,943, provides a compact processor for automatically continuously completely processing typical periapical and bite-wing size films. The apparatus occasionally caused the film to jam somewhere along its excursion due to the film guide track means failing to guide the film properly into succeeding drive roller means. More importantly, the many expensive rubber rollers needed to drive the film through the developing, fixing and rinsing tanks and drying areas require frequent cleaning to prevent the drying and caking of chemicals thereon. In practice, the rollers are infrequently given the necessary maintenance attention.

Further, the working surfaces of each pair of rubber rollers are initially in slight, or near tangential contact in order that the film may be readily received thereinbetween and squeezed gently thereby before proceeding to the next pair of driving rotating rollers. The degree of closeness or contact should be closely controlled if the film is to be drawn through the apparatus smoothly and yet not have its silver stripped or otherwise damaged by roller action or jamming. The rubber material should be maintained within acceptable durometer readings and must not be permitted to become so porous that the solution chemicals will penetrate therein to result in a surfae cake thereon upon drying thereof.

The present invention substantially overcomes both deficiencies of the apparatus of U.S. Pat. No. 4,032,943. That is, by eliminating the V-grooved film guide track means of the patented apparatus and substituting therefor curved deflection guide members, uninterrupted and jam-free travel of the film is substantially insured by accurately directing the leading edge thereof into a successive downstream pair of rotating rollers. Further, the film is always presented properly to the next roller pair with both sides of the film exposed to the respective fluid baths. It must be appreciated that the preiapical and bite-wing x-ray film, even though small, has a tendency to sag when traveling the curvilinear path through the various chemical solutions.

Secondly, at least in the body of the respective tanks and in the drying area, both of the two vertically disposed roller support frames 170 and 172 are molded with a plurality of spaced cut-out portions resulting in a like number of key-hole shaped cantilevered spring segments integral with the roller support frames. By rotatably mounting one roller of each pair to the cantilevered spring segments, we have found that plastic rollers may be used in lieu of the expensive rubber rollers. Additionally, the tight tolerances required to achieve the proper degree of tangential contact, or near tangential contact between the rollers of each pair of rubber rollers is no longer necessary due to controlled spring-action between individual plastic rollers of each pair thereof which automatically maintains them in proper resilient contact.

DETAILED DESCRIPTION OF THE INVENTION

Figure 1:
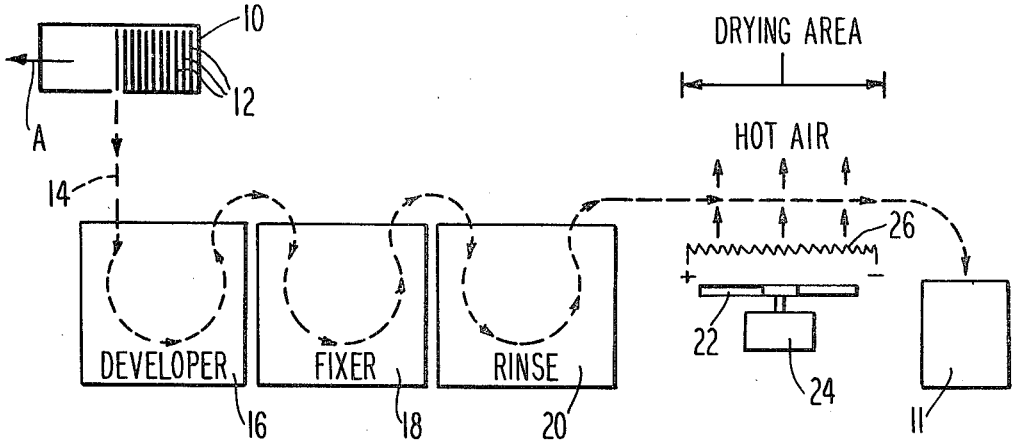
PRIOR ART Fig. 1
FIG. 1 is a schematic view of the dental x-ray film processing apparatus of the present invention, and is substantially identical with FIG. 1 of U.S. Pat. No. 4,032,943.

In FIG. 1, magazine dispenser 10 contains a plurality of dental x-ray films 12 of periapical or bite-wing size. The referenced patent describes in detail the movements of dispenser 10 by an indexing mechanism and the dispensing of films, one at a time, into developer tank 16, from whence each film passes into a fixer tank 18, a rinse tank 20, and finally to the drying area and container 11. Fan 22, driven by fan motor 24, forces air through electric wire heating means 26 to dry films 12 passing thereover.

Figure 2:
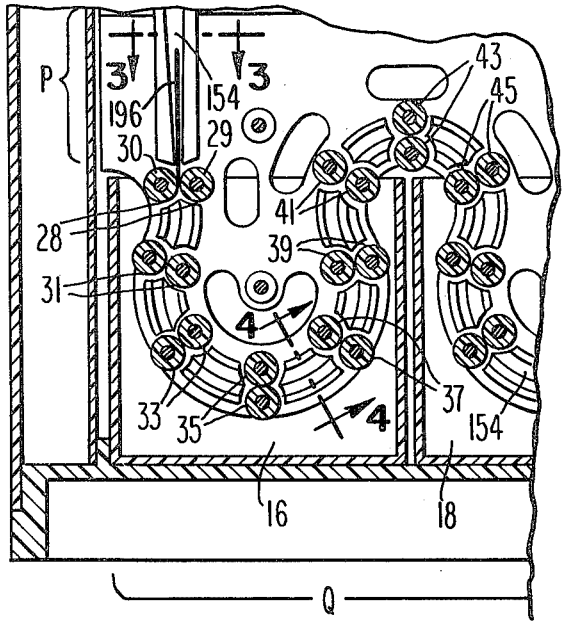
PRIOR ART Fig. 2
FIG. 2 is a fragmentary sectional view, partially sectioned, of the developer apparatus of FIG. 1, similar to a portion of FIG. 6 of the referenced patent, illustrating prior art film guide track means.
Figure 3:
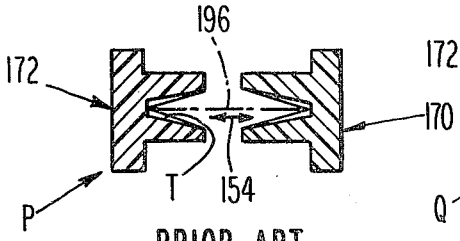
PRIOR ART Fig. 3
FIGS. 3 and 4 are sectional views taken along lines 3—3 and 4—4 respectively of FIG. 2, similar to FIGS. 8 and 9 of the referenced patent, illustrating in detail the prior art film guide track means.
Figure 4:
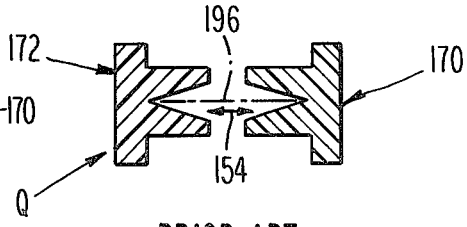
PRIOR ART Fig. 4

In FIG. 2, exposed film 196 is released from dispenser 10 and enters film guide track means 154 comprising an upstream portion P and a downstream portion Q, the latter guiding the film through and out the respective tanks. Film 196 contacts the tapered portion T (FIG. 3) of film guide track means 154 at portion P which directs the film into a first pair of rotating drive rollers 28, comprising rollers 29 and 30. Upon leaving the rollers at portion P, the film is further guided and propelled by portion Q of the guide means 154, characterized by the absence of tapered portion T as shown in FIG. 4, into drive roller pairs 31, 33, 35, 39, 41, 43, 45, etc.

Figure 5:
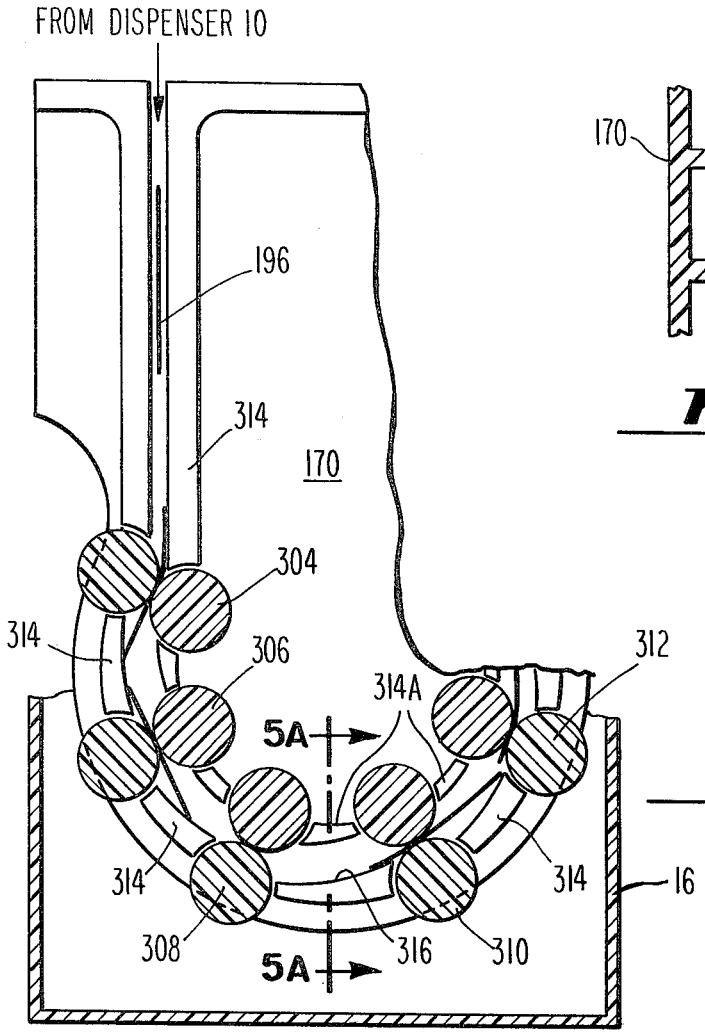
FIG. 5 is a diagrammatic view, partially sectioned, of a portion of the apparatus shown in FIGS. 2 and 5 illustrating improved guide means for guiding the moving dental x-ray film.
Figure 6:
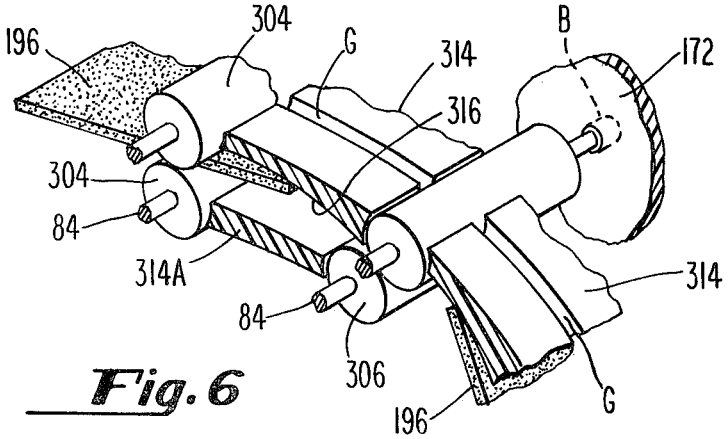
FIG. 6 is a fragmentary perspective view, partially sectioned, of a portion of the apparatus of FIG. 5.

As mentioned previously, the film's excursion through the apparatus of the referenced patent is interrupted occasionally, due to inability of the film guide track means 154 to properly guide the film along its curvilinear path through the respective tanks. In view thereof, improved film guide means for the dental x-ray film apparatus is provided in accordance with one aspect of the present invention and is described in detail below. Thus, in FIGS. 5 and 6, film 196, upon exiting dispenser 10 has its movement into developer tank 16 controlled by a series of pairs of spaced drive rollers 304, 306, 308, etc. In lieu of the prior art film guide track means 154, deflector plates 314 are substituted therefor. Except for the deflector guide plates 314 disposed between dispenser 10 and roller pair 304, each guide plate 314 has a curved film contact surface 316 which automatically deflects or guides the leading edge of each moving film 196 into the rotating converging surfaces of a downstream pair of drive rollers. Smaller deflector guide plates 314A may optionally be disposed adjacent guide plates 314 i.e., interiorly disposed when the film is moving around a concave path, for example, from rollers 312 to 320 (FIG. 7); and exteriorly disposed when the film moves around a convex path as when entering the fixer tank 18 from developer tank 16. More specifically, where the direction of travel of film starts reversing, for example, from roller pair 320 to pair 322, deflector guide plate 314 will be disposed interiorly plate 314A to ensure that the direction of travel of film 196 is similarly reversed.

Figure 5A:
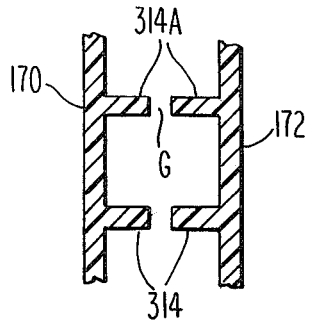
FIG. 5A is a sectional view taken along line 5A—5A of FIG. 5.

Guide plates 314 and 314A are preferably molded integrally with roller support frames 170 and 172 as illustrated in FIG. 5A and are provided with gaps G centrally longitudinally thereof to encourage efficient flow of the chemicals over the film, the gaps G being maintained by suitably disposed standoffs (not shown) provided between the roller support frames.

Drive roller shafts 84 rotatably mount the drive rollers in the respective roller support frames, typically, by means of bushings B (FIG. 6) provided therein. Roller support frames 170 and 172 are supported within each of the respective tanks from support means disposed thereabove, as clearly described in the referenced patent.

In the operation of the improved deflector guide means 314, film 196 is grasped between a pair of rotating drive rollers and propelled to the next downstream pair. The pairs of rollers are spaced such that a downstream pair of rollers grasps the leading edge of the film prior to the trailing edge thereof being released by an immediately upstream pair. The curved film contact surface 316 of the deflector guide plates automatically and precisely directs the moving film into a next downstream pair, and so on.

Figure 7:
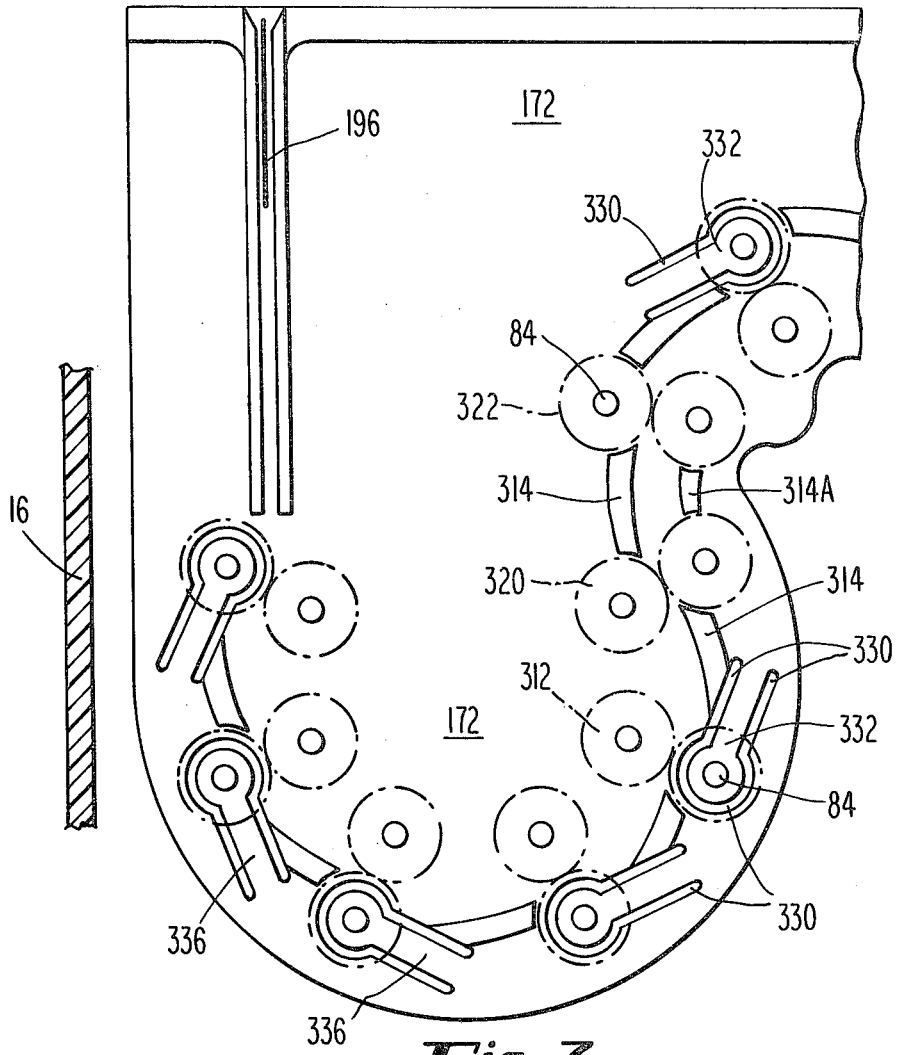
FIG. 7 is an elevational view, shown diagrammatically, of a portion of the developing tank, with rollers shown in phantom and parts omitted for clarity, illustrating the cantilevered spring members of the present invention.
Figure 8:
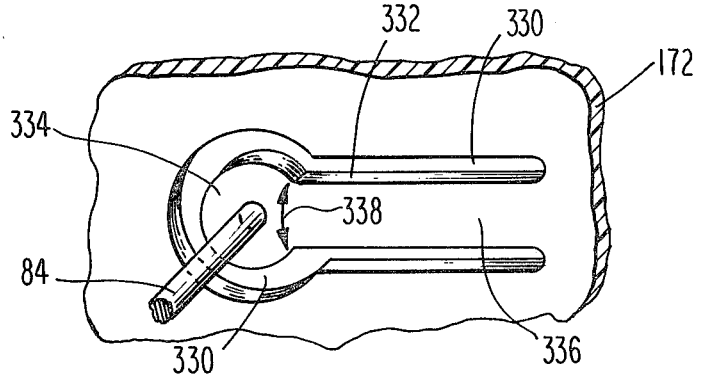
FIG. 8 is a prespective view of a cantilevered spring member of FIG. 7.

In FIGS. 7 and 8, vertically disposed plastic roller support frame 172 is molded with plurality of spaced cut-out or air portions 330 therein, resulting in roller support frame 172 being provided with a like number of corresponding key-hole shaped segments or cantilevered spring members 332 integral therewith. Matching frame 170 is similarly molded. Roller shafts 84 are rotatably mounted centrally to bulbous portions 334 of key-hole shaped segments 332. Thus, as the film is grasped between the converging rotating rollers, let or strip portion 336 of segment 332 permits the roller coacting therewith to move resiliently in the direction of arrow 338 thereby allowing the film to be gently grasped and squeezed by the pair of rollers as it passes therethrough. Resiliency of the cantilevered spring segments or members may be controlled by limiting the length and width of strip 336 in the molding process. Of course, cut-out or air portions 330 may be formed after roller support frames 170 and 172 have been molded. It is understood that each of the key-hole shaped segments or members 332 need not be identical if it is subsequently determined that one or more should possess a greater or less resiliency.

In FIG. 7, no cantilevered spring members 332 are shown cooperating with roller pairs 320 and 322, it being understood that the prior art rubber rollers may be used thereat as before. However, it is further understood that cut-out portions 330 could readily have been molded in roller support frames 170 and 172 adjacent rollers 320 and 322, if desired, to provide cantilevered spring action thereat to thereby permit the use of plastic rollers.

It is appreciated that the rollers shown and described in the drying area in the referenced patent, and not shown herein, are provided with cantilevered spring segment or members 332, to thereby permit plastic rollers to be employed thereat with the resulting attendant advantages discussed hereinabove. Similarly, fixer tank 18 and rinse tank 20 are also provided with the cantilevered spring members 332.

Plastic components may typically comprise a chemically resistant material such as polysulfone, or Kynar, a polyvinylidene fluoride trademark product of Pennwalt Corporation, Philadelphia, Pennsylvania, assignee of the present invention.

We claim:

1. Apparatus for continuously automatically developing a plurality of film separately released by a dispenser disposed in dispensing relaltionship to a developer tank for developing said film, said apparatus including a fixer tank, a rinse tank, and a drying area in respective sequential communication with said developer tank, each of said tanks containing respective liquids therein, roller support means for rotatably mounting pairs of spaced drive rollers in a curvilinear path sequentially through said liquids in each of said tanks and linearly along said drying area, means to operably rotate each of said pairs of drive rollers such that said film released by said dispenser is grasped by said pairs of rotating rollers to be sequentially propelled through said drying area, the improvement thereto comprising, cantilevered spring means provided in said roller support means at portions thereof where one of said rollers of a pair thereof is rotatably mounted, said cantilevered spring means having a leg portion integral with said roller support means and a cut-out portion surrounding said leg portion.

2. Apparatus of claim 1 wherein said roller support means comprises a pair of spaced vertically disposed plates and said cantilevered spring means are symmetrically disposed in each thereof.

3. Apparatus of claim 2 further characterized by a bulbous portion at cantilevered end of said leg portion providing a key-hole shaped cantilevered spring member, said cut-out portion surrounding said leg portion and said bulbous portion.

4. Apparatus of claim 3 wherein one of said rollers of a pair thereof is rotatably mounted to said bulbous portion.

5. Apparatus of claim 4 wherein at least one of said roller pairs is a chemically resistant material having less resiliency and less porosity than rubber, said material being selected from the group consisting of polysulfone and polyvinylindene fluoride.

6. Apparatus for continuously automatically developing a plurality of film separately released by a dispenser disposed in dispensing relationship to a developer tank for developing said film, said apparatus including a fixer tank, a rinse tank, and a drying area in respective sequential communication with said developer tank, each of said tanks containing respective liquids therein, roller support means for rotatably mounting pairs of spaced drive rollers in a curvilinear path sequentially through said liquids in each of said tanks and linearly along said drying area, said roller support means comprising a pair of spaced vertically disposed plates, means to operably rotate each of said pairs of drive rollers such that said film released by said dispenser is grasped by said pairs of rotating rollers to be sequentially propelled through said drying area, the improvement thereto comprising, deflector guide means supported between said vertically disposed plates, each of said deflector guide means having a curved film contact surface for automatically deflecting leading edge of film being propelled into an immediate downstream pair of rotating drive rollers until said deflected film is propelled through said drying area, cantilevered spring means symmetrically disposed in each of said vertical plates at portions thereof where one of said rollers of a pair thereof is rotatably mounted, each of said cantilevered spring means having a leg portion integral with said vertical plates, and a cut-out portion surrounding said leg portion.

7. Apparatus for continuously automatically developing a plurality of film separately released by a dispenser disposed in dispensing relationship to a developer tank for developing said film, said apparatus including a fixer tank, a rinse tank, and a drying area in respective sequential communication with said developer tank, each of said tanks containing respective liquids therein, roller support means for rotatably mounting pairs of spaced drive rollers in a curvilinear path sequentially through said liquids in each of said tanks and linearly along said drying area, said roller support means comprising a pair of spaced vertical plates, means to operably rotate each of said pairs of drive rollers such that said film released by said dispenser is grasped by said pairs of rotating rollers to be sequentially propelled through said drying area, the improvement thereto comprising a plurality of pairs of opposed spaced deflector guides, each of said deflector guides of each pair thereof having a longitudinally disposed gap centrally thereof to thereby form a plurality of pairs of split pairs of deflector guides, each split pair of deflector guides of each of said pairs of split pairs of deflector guides having one guide thereof integral with one of said vertical plates, and other guide thereof integral with other of said vertical plates, said film initially contacting one of said split pairs of guides of each pair of split pairs thereof, said split pair deflector guide of each of said plurality of pairs of split pairs so initially contacted comprising an initial contact split pair deflector guide, each of said initial contact split pair deflector guides disposed exteriorly the other split pair deflector guide of each of said pairs of split pair deflector guides when said film being propelled traces a concave path, and interiorly thereof when said film being propelled traces a convex path, each of said initial contact split pair deflector guides having a curved film contact surface for automatically deflecting leading edge of film being propelled into an immediate downstream pair of rotating drive rollers until said deflected film is sequentially propelled through said drying area.

* * * * *